US011041364B2

(12) United States Patent
Ostrovskiy et al.

(10) Patent No.: US 11,041,364 B2
(45) Date of Patent: Jun. 22, 2021

(54) INSERT SAFETY VALVE (VARIANTS)

(71) Applicant: Joint Stock Company "Novomet-Perm", Perm (RU)

(72) Inventors: Viktor Georgievich Ostrovskiy, Perm (RU); Dmitrii Valeryevich Gorbunov, Perm (RU); Aleksej Aleksandrovich Fotiev, Perm (RU)

(73) Assignee: Joint Stock Company "Novomet-Perm", Perm (RU)

( * ) Notice: Subject to any disclaimer, the term of this patent is extended or adjusted under 35 U.S.C. 154(b) by 0 days.

(21) Appl. No.: 16/981,632

(22) PCT Filed: Sep. 25, 2019

(86) PCT No.: PCT/RU2019/000675
§ 371 (c)(1),
(2) Date: Sep. 16, 2020

(87) PCT Pub. No.: WO2020/145841
PCT Pub. Date: Jul. 16, 2020

(65) Prior Publication Data

US 2021/0025261 A1 Jan. 28, 2021

(30) Foreign Application Priority Data

Jan. 9, 2019 (RU) ..... 2019100186

(51) Int. Cl.
*E21B 34/10* (2006.01)
*E21B 23/02* (2006.01)

(52) U.S. Cl.
CPC ..... *E21B 34/106* (2013.01); *E21B 23/02* (2013.01); *E21B 2200/05* (2020.05); *E21B 2200/06* (2020.05)

(58) Field of Classification Search
CPC . E21B 34/10; E21B 23/02; E21B 2200/05–06
See application file for complete search history.

(56) References Cited

U.S. PATENT DOCUMENTS 7,891,428 B2 2/2011 Martin et al.
7,967,074 B2 6/2011 Lake et al.
(Continued)

FOREIGN PATENT DOCUMENTS

CA 2586192 A1 5/2006
FR 2602820 A1 2/1988
(Continued)

OTHER PUBLICATIONS

Decision to Grant a patent dated Aug. 6, 2019, for Russian Patent Application No. 2019100186.
(Continued)

*Primary Examiner* — Tara Schimpf
*Assistant Examiner* — Dany E Akakpo
(74) *Attorney, Agent, or Firm* — Meunier Carlin & Curfman LLC

(57) ABSTRACT

The invention relates to the oil industry and the production of oil. An insert safety valve is mounted inside a piping safety valve in a production tubing string and comprises a housing having a longitudinal bore, an upper landing assembly with extendable slips for fixing inside the piping safety valve having a landing nipple, a hydraulic line, annular seals and a valve device with a spring-driven element. The insert safety valve is mounted on a carrying cable, the hydraulic line has tubes connected to two valves. The first valve is connected to the piping safety valve housing in the production tubing string, and the second valve extends to a port in the inner portion of the landing nipple. A hollow sleeve functions as a moving element, and the valve device is formed as openings in the sleeve and in the housing, wherein the openings are configured to being aligned.

4 Claims, 4 Drawing Sheets

(56) References Cited

U.S. PATENT DOCUMENTS

| | | | | |
|---|---|---|---|---|
| 2010/0025045 | A1* | 2/2010 | Lake | E21B 34/066 166/373 |
| 2012/0168175 | A1* | 7/2012 | Lauderdale | E21B 34/10 166/373 |

FOREIGN PATENT DOCUMENTS

| | | | |
|---|---|---|---|
| RU | 2160357 | C2 | 12/2000 |
| RU | 2190083 | C1 | 9/2002 |
| RU | 2566353 | C1 | 10/2015 |
| RU | 2672898 | C1 | 11/2018 |
| WO | 2010014398 | A2 | 2/2010 |

OTHER PUBLICATIONS

International Search Report for International Application PCT/RU2019/000675 dated Dec. 5, 2019.

* cited by examiner

INSERT SAFETY VALVE (VARIANTS)

CROSS REFERENCE TO RELATED APPLICATION

This is a national stage application of PCT/RU2019/000675 filed Sep. 25, 2019, which claims priority to Russian Patent Application No. 2019100186, filed Jan. 9, 2019, the contents of which are incorporated herein by reference.

FIELD OF THE INVENTION

The invention relates to oil industry and can be used for the production of oil.

STATE OF THE ART

Known is an insert safety valve [CA2586192 dated Feb. 11, 2004 or U.S. Pat. No. 7,891,428 dated 22 Feb. 2011] comprising a housing having a longitudinal bore and an annular cavity, a coupling member, a sealing element mounted within the longitudinal bore, fluid flow passages, a valve device with a sleeve. Said insert valve is mounted inside the piping safety valve available in the production tubing string and fixes it in the open state. In operation, the fluid flow passes through bypass channels which can be closed with a valve device if necessary. Opening and closing of the valve is controlled with a hydraulic line of the piping safety valve.

A drawback of this piping safety valve is that it requires improvements (if it is functional, but the equipment needs to be lowered on a cable, a wire, a coiled tubing, then perforation of a control line is performed, and after that the control line controls the insert safety valve) to ensure operation of the insert safety valve.

Further, known is an insert safety valve [U.S. Pat. No. 7,967,074, published on 28.01.11] which can be considered the closest prior art to the claimed invention. The known safety valve comprises a housing having a longitudinal bore, a landing assembly in the upper portion with extendable slips, a coupling member, fluid flow passages, valve members, a spring-driven sleeve and a landing nipple. Such safety valve can be used in case a flapper safety valve mounted in the production tubing string fails. Meanwhile, the insert safety valve is mounted within the failed piping safety valve, ensures its constantly open state, and uses its hydraulic control line.

A drawback of this device is a necessity to improve a safety valve present in the string and the fact that it cannot be used for its intended purpose after the insert safety valve is removed. This invention is practical to use only in case of a failure of the main (piping) valve. Due to a power source line or a rod extending within, this variant is unsuitable if activation (fixing) of the main safety valve to its closed state is required.

SUMMARY OF THE INVENTION

The object of the present invention is to provide an insert safety valve that maintains the operability of the piping safety valve mounted in the production tubing string and configured to operate electrical submersible pumps suspended on a carrying cable that extends through the interior of the piping safety valve.

The technical effect is achieved by providing an insert safety valve mounted within a flapper piping safety valve in a production tubing string, wherein the insert safety valve comprises a housing having a longitudinal bore, a landing nipple with extendable slips for fixing inside the piping safety valve having a landing nipple, a hydraulic line, annular seals and a valve device with a spring-driven element, the insert safety valve is lowered on a carrying cable, the hydraulic line is a tee connector coupled to two valves via tubes, the first of the valves being connected to the piping safety valve in the production tubing string, and the second of the valves extending to a slot in the inner portion of the landing nipple, wherein a hollow sleeve functions as a moving element, and the valve device is configured for aligning openings in the sleeve and the housing.

Furthermore, the valves on the hydraulic line are configured to open at various pressures.

During operation of the insert safety valve with the suggested construction in a universal production tubing (i.e., in a string having a standard piping safety valve operable without the valve of the present invention) damaging of the piping safety valve mounted inside the production tubing string is prevented since the piping safety valve can be used for its intended purpose after the insert safety valve is removed.

The piping safety valve can be operated in a normal mode, and if the equipment needs to be lowered on a carrying cable through the piping safety valve, the insert valve is mounted inside the landing nipple. In this case, the piping safety valve remains open throughout the mounting operation of the insert valve, and the internal space is sealed with the insert valve, if necessary. In an alternative second variant, a separate hydraulic control line extends to the insert safety valve (inside the production tubing string). In this case, each safety valve is controlled separately from the surface.

BRIEF DESCRIPTION OF THE DRAWINGS

The essence of the present invention is explained with reference to the drawings, in which.

DETAILED DESCRIPTION OF THE INVENTION

Figure 1:
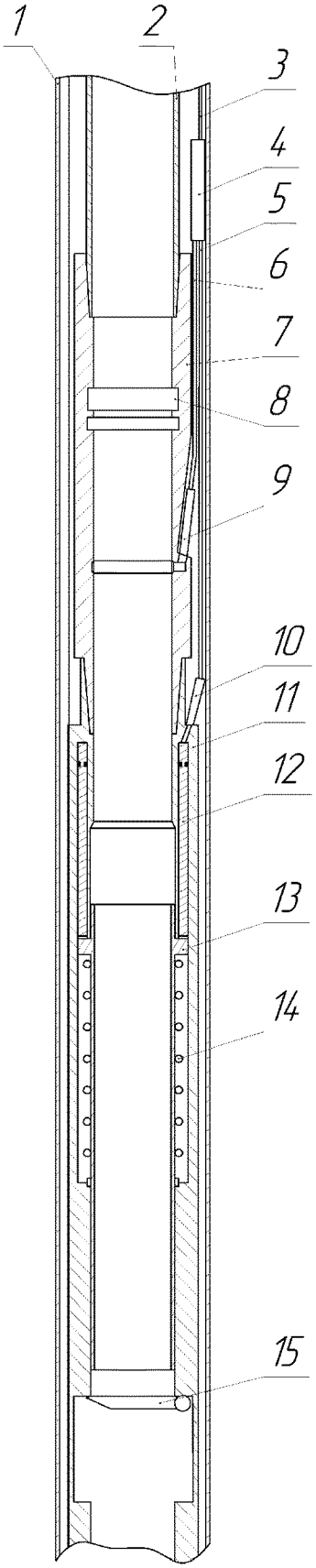
FIG. 1 shows a longitudinal cross-section of a piping safety valve.

A piping safety valve (FIG. 1) is mounted in a well-bore casing string 1 on a production tubing string 2. A hydraulic control line 3, which comprises a tee connector 4 with outlet tubes 5 and 6, extends to the safety valve. A landing nipple 7 having an annular slot 8 in the inside cavity thereof is screwed onto an end of the production tubing 2. An outlet tube 6 is connected to the inner cavity of the landing nipple 7 through a valve 9, and the tube 5 is connected to the safety valve housing 11 fitted onto the landing nipple 7 through a valve 10. A piston 12 is provided in the inner cavity of the housing 11, a sliding sleeve 13 is provided under the piston with a spring 14 put on the sliding sleeve. A sealing shutter 15 in the form of a flapper is mounted in the lower part of the housing 11.

Figure 2:
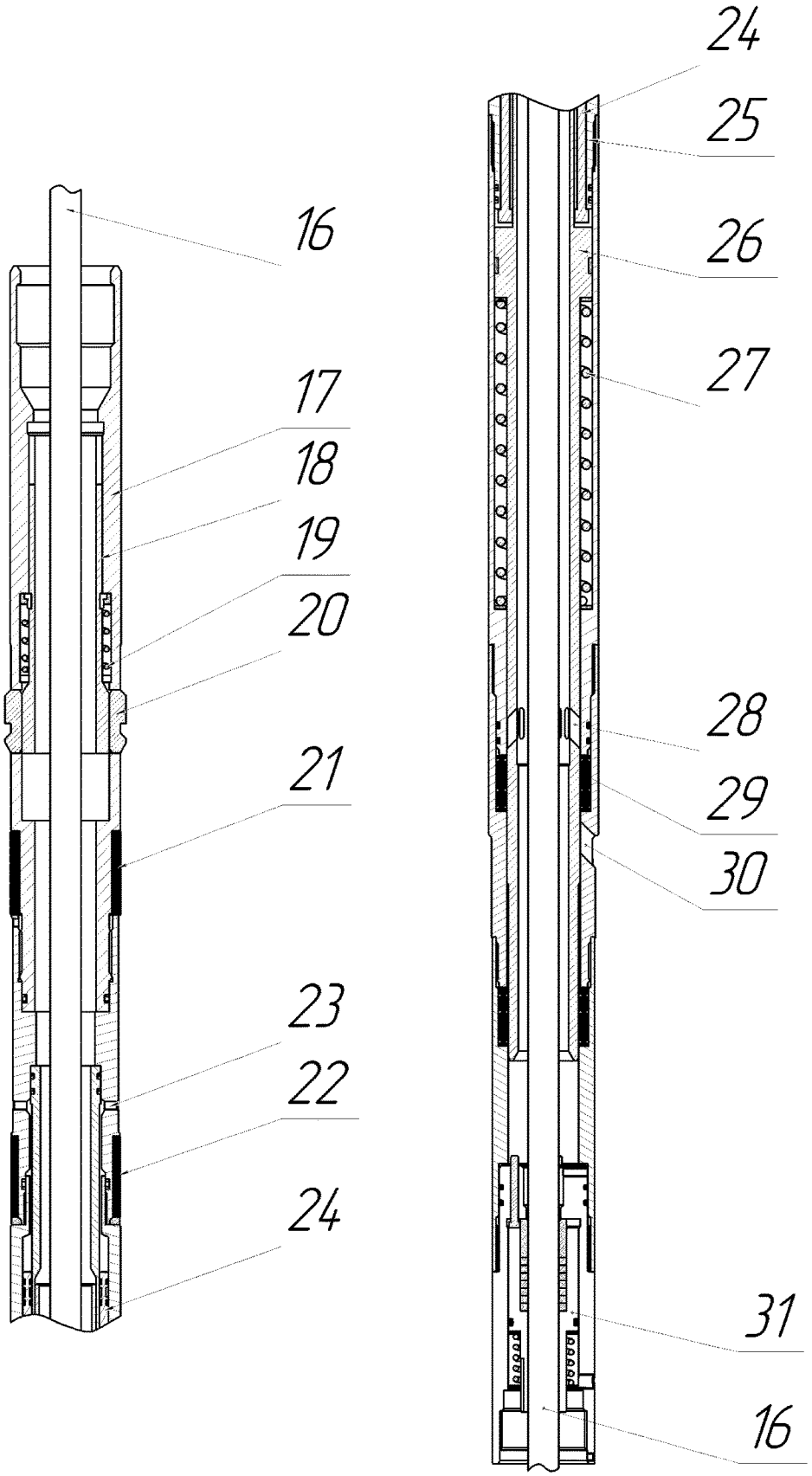
FIG. 2 shows a longitudinal cross-section of an insert safety valve.
Figure 3:
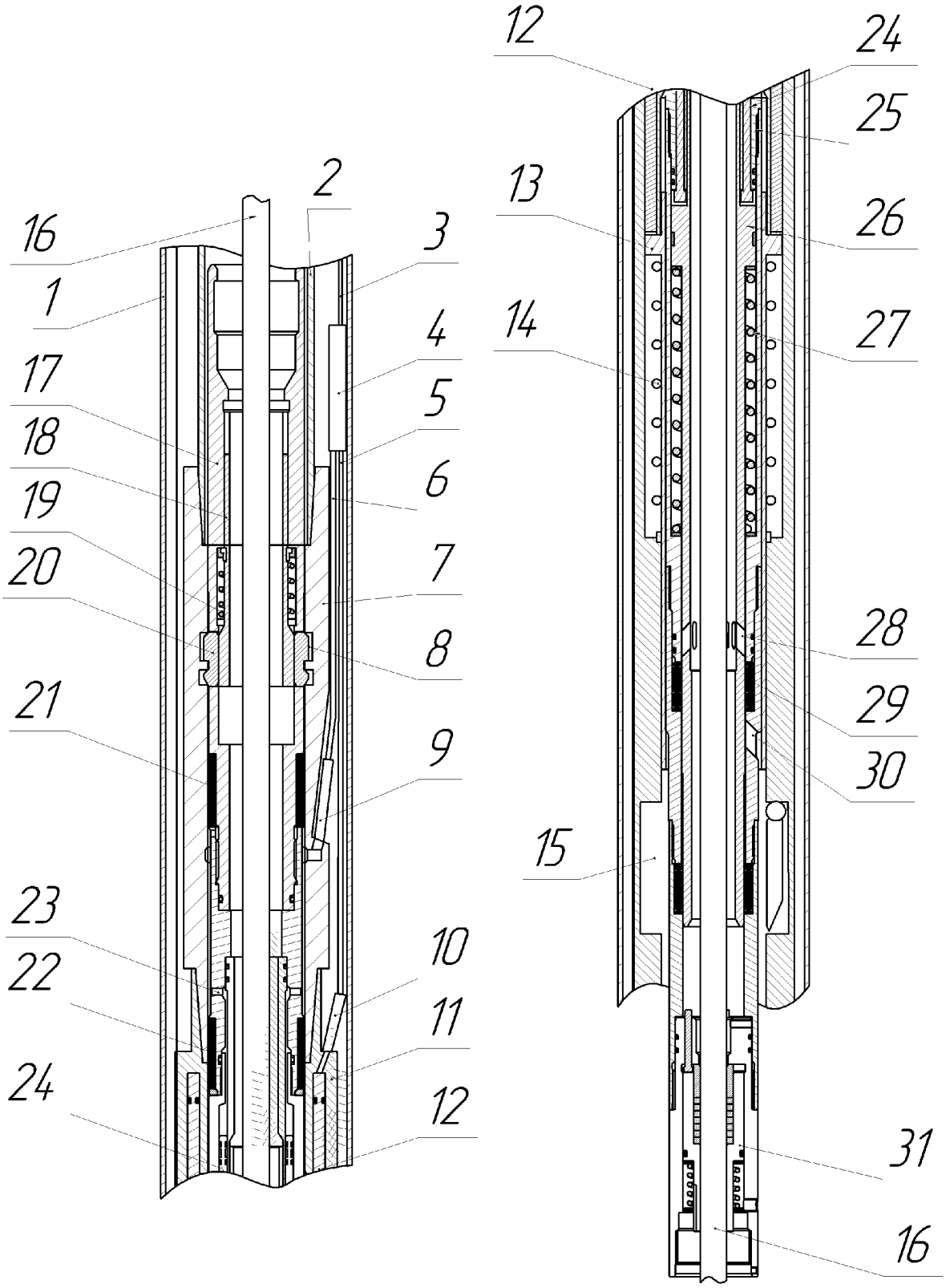
FIG. 3 shows the arrangement of the insert safety valve inside the piping safety valve.

The insert safety valve (FIG. 2) is mounted on a carrying cable 16 and comprises a landing assembly having a locator 17 with a sleeve 18, a spring 19 and extendable slips 20. A sealing assembly comprising seals 21 and 22 is provided below the locator 17, with a port 23 formed between the seals. The port 23 communicates the outside with a piston 24 mounted in the housing 25 having a longitudinal bore. The valve device comprises the piston 24 contacting with a moving element formed as a hollow sliding sleeve 26 biased with a spring 27. The sleeve 26 has openings 28 that can either be aligned with openings 30 formed in the insert safety valve housing or be separated from the openings 30 by a seal 29. A second seal assembly 31 is provided in the lower part of the insert safety valve on the cable 16.

Figure 4:
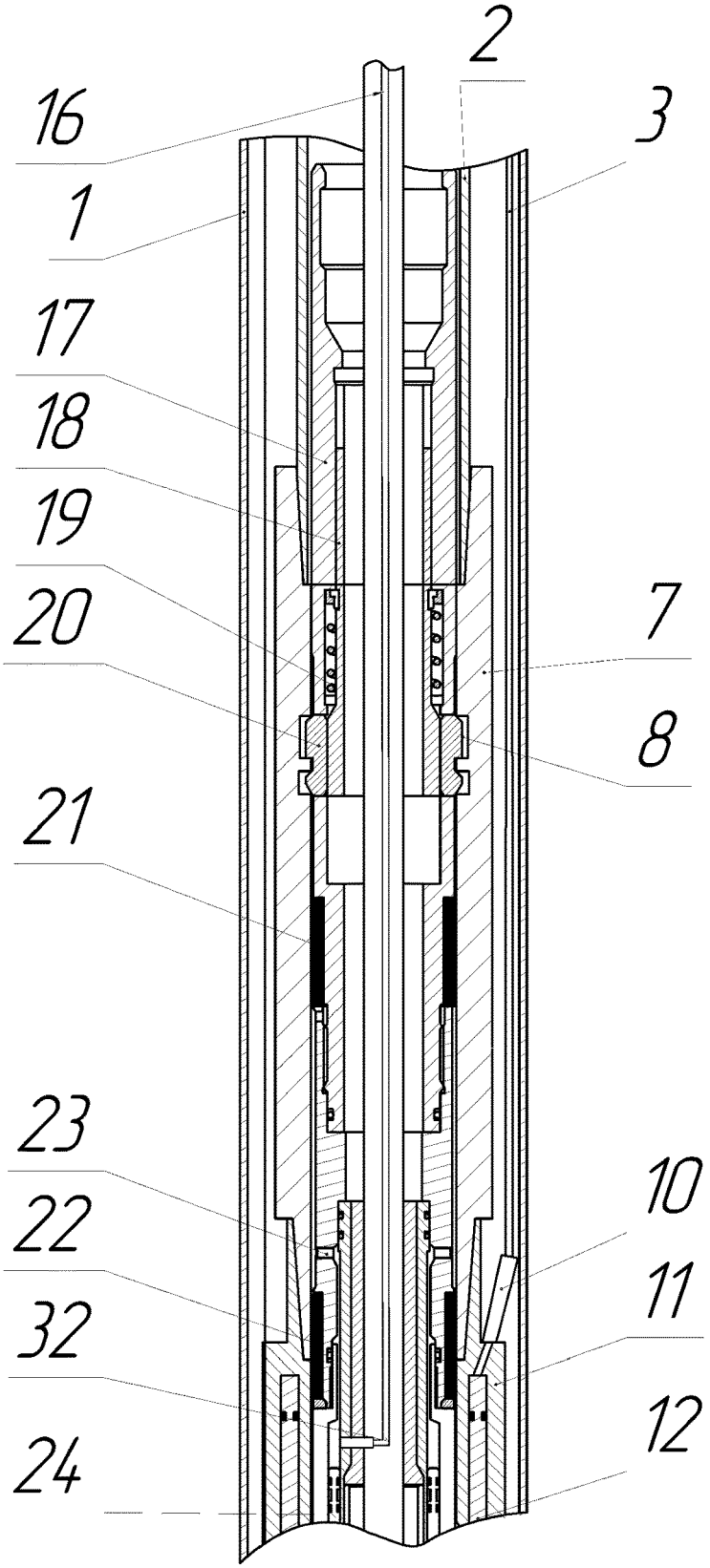
FIG. 4 shows the arrangement of a separate hydraulic control line.

An alternative variant (FIG. 4) differs in that a separate hydraulic line 32 configured to control opening and closing the insert safety valve independently from the piping safety valve extends along the carrying cable 16, and the hydraulic control line 3 with the valve 10 extends directly to the housing 11. The line 32 may extent either separately from the carrying cable 16 or inside it. When the insert safety valve is removed, the piping safety valve may be controlled with the hydraulic control line 3.

The device is mounted as follows.

An additional landing nipple 7 is screwed on the top of the piping safety valve housing 11 (mounting instead of or in addition to the available landing nipple of the safety valve is possible). The hydraulic control line 3 is connected to the housing 11 of the piping safety valve and to the landing nipple 7 via a tee connector 4 (or directly, in the second variant). In order to open the sealing shutter 15, a predetermined pressure is introduced into the control line 3, wherein the pressure opens the valve 10 and shifts the piston 12, which, in turn, shifts the sleeve 13, which opens the shutter 15. Herewith, in the first variant, the pressure in the line 3 should be lower than the pressure needed to open the valve 9. If it is required to lower the assembly on a carrying cable 16 inside a piping safety valve, the insert safety valve is mounted on the carrying cable 16, said insert safety valve includes the locator 17 mounted opposite the slot 8 while lowering. An additional collet tool is lowered inside the insert safety valve (not shown in the figures since the construction is standard and does not form a part of the insert valve), where it captures the sleeve 18 on its internal diameter and shifts it. It causes extension of the slips 20 that enter the slots 8. After the locator 17 is installed into the slot 8, the pressure in the control line 3 rises to the level required to open the valve 9. After the valve 9 is opened, the fluid from the tube 6 enters the port 23, reaches the piston 24 and shifts it. The piston 24, in turn, shifts the sleeve 26, thereby aligning the openings 28 with the openings 30. When the pressure supply through the hydraulic line 3 is stopped or reduced, the spring 27 biases the sleeve 26 and the piston 24 into an upper position, which results in a seal 29 separating the openings 28 and 30, thus isolating the insert safety valve. The fluid flow through the insert safety valve is stopped.

In an alternative variant, the insert safety valve is controlled via the line 32, through which the pressure is applied to the piston 24, and then the control is carried out as in the main variant.

Presented insert safety valve mounting method ensures that the piping safety valve control line is not damaged, thus, it remains operable and can be used after the insert safety valve is removed.

The invention claimed is:

1. An insert safety valve mounted inside a piping safety valve in a production tubing string, the insert safety valve comprising:

a housing having a longitudinal bore, an upper landing assembly with extendable slips for fixing inside the piping safety valve, the landing assembly comprising a landing nipple, the landing nipple having an inner surface, the insert safety valve further comprising:

a hydraulic line, annular seals, and a valve device with a spring-driven element, wherein the insert safety valve is mounted on a carrying cable, the hydraulic line comprising tubes connected with two pressure opening valves, wherein the first of the two pressure opening valves being connected to the piping safety valve in the production tubing string, and the second of the two pressure opening valves extending to a port in the inner surface of the landing nipple, and a hollow sleeve functions as a moving element, wherein the valve device is formed by openings in the sleeve and openings in the housing, so that the valve device is open when the openings in the sleeve and the openings in the housing are aligned.

2. The insert safety valve of claim 1, wherein the hydraulic line tubes with pressure opening valves are connected to a tee connector that is connected with a tube from the surface.

3. The insert safety valve of claim 1, wherein the valves on the hydraulic line are configured to open at various pressures.

4. An insert safety valve mounted inside a piping safety valve in a production tubing string, the insert safety valve comprising a housing having a longitudinal bore, an upper landing assembly with extendable slips for fixing inside the piping safety valve the landing assembly comprising a landing nipple, the insert safety valve further comprising a hydraulic line, annular seals and a valve device with a spring-driven element, wherein the insert safety valve is fixed on a carrying cable and has a separate hydraulic line, the separate hydraulic line being controlled from the surface and extending along the longitudinal bore of the housing, wherein a hollow sleeve functions as a moving element, and the valve device is formed by openings in the sleeve and openings in the housing, so that the valve device is open when the openings in the sleeve and the openings in the housing are aligned.

* * * * *